United States Patent [19]

Young et al.

[11] Patent Number: 4,919,268

[45] Date of Patent: Apr. 24, 1990

[54] CONTAINERS

[75] Inventors: Michael E. Young, Cardiff; David M. Edwards, South Glamorgan; Robin Lyons, Cardiff, all of Great Britain

[73] Assignee: Creative Design and Packaging Cardiff Limited, United Kingdom

[21] Appl. No.: 10,887

[22] PCT Filed: Jun. 9, 1986

[86] PCT No.: PCT/GB86/00330

§ 371 Date: Apr. 6, 1987

§ 102(e) Date: Apr. 6, 1987

[87] PCT Pub. No.: WO86/07335

PCT Pub. Date: Dec. 18, 1986

[30] Foreign Application Priority Data

Jun. 8, 1985 [GB] United Kingdom ..... 8514554

[51] Int. Cl.[5] ..... B65D 81/36

[52] U.S. Cl. ..... 206/509; 206/515; 220/23.4; 220/23.6; 446/73; 446/111; 446/122

[58] Field of Search ..... 206/503–505, 206/509, 511, 515–520; 220/23.4, 23.6, 23.8, 23.83; 446/71, 73–77, 111, 116, 117, 120, 122

[56] References Cited

U.S. PATENT DOCUMENTS

| | | | |
|---|---|---|---|
| 2,826,333 | 3/1958 | Rodemich | 206/509 |
| 3,076,289 | 2/1963 | Gallo | 206/511 |
| 3,303,965 | 2/1967 | Parker et al. | 206/511 |
| 3,393,827 | 7/1968 | Asenbauer | 206/504 |
| 3,419,176 | 12/1968 | Lipfert et al. | 206/504 |
| 3,424,334 | 1/1969 | Goltz | 220/23.6 |
| 3,437,423 | 4/1969 | Mondiadis | 206/511 |
| 3,633,793 | 1/1972 | Edmundson . | |
| 3,670,449 | 6/1972 | Lemkin et al. . | |
| 3,815,281 | 6/1974 | Kander | 206/504 |
| 4,003,491 | 1/1977 | Wells et al. . | |
| 4,067,475 | 1/1978 | Pinkau et al. | 206/504 |
| 4,106,657 | 8/1978 | Dogliotti | 220/23.4 |
| 4,170,082 | 10/1979 | Freedman | 220/23.4 |

FOREIGN PATENT DOCUMENTS

| | | | |
|---|---|---|---|
| 2239337 | 3/1974 | Fed. Rep. of Germany . | |
| 2250131 | 4/1974 | Fed. Rep. of Germany . | |
| 2511375 | 10/1976 | Fed. Rep. of Germany . | |
| 2740494 | 3/1979 | Fed. Rep. of Germany . | |
| 1141279 | 8/1957 | France . | |
| 1513472 | 1/1968 | France . | |
| 1529853 | 5/1968 | France . | |
| 2276236 | 1/1976 | France . | |
| 2322063 | 3/1977 | France . | |
| 1077440 | 7/1967 | United Kingdom | 220/23.4 |
| 1511697 | 5/1978 | United Kingdom . | |
| 1600655 | 10/1981 | United Kingdom . | |

*Primary Examiner*—Jimmy G. Foster
*Attorney, Agent, or Firm*—Lowe, Price, LeBlanc, Becker & Shur

[57] ABSTRACT

A container (1), such as a yoghurt or cream pot, is of tube-like form with a side wall of circular cross-section tapering towards the base (2) from an open mouth (3). The base and mouth comprise opposite ends of the container. A flange plate (4) surrounds the open mouth (3) and is provided with sockets in the form through holes (5) punched through each of the four corners. The base (2) of the container has a central cruciform projection (6) and in the angles between each pair of arms of the cruciform a projecting plug or stud (7) is formed. The holes (5) and studs (7) comprise mutually interchangeable connection parts. A plurality of like containers (1) can, when empty, be assembled in a desired spatial relationship by interengaging a stud (7) in a hole (5). The building system so formed thus forms a knock-down constructional toy.

1 Claim, 6 Drawing Sheets

CONTAINERS

Standard tub-like containers are in existence and are used for the sale of products such as yoghurt and cream. These containers are disposable and normally are of very little use once they have been emptied of their contents. It is an object of this invention to modify such containers so that they will have a useful life after they have been emptied.

In accordance with the present invention there is provided a container, comprising opposite ends, one end of the concontainer having a laterally extending flange, a portion of the flange separate from its periphery and an opposite end of the container incorporating mutually interengageable connection parts enabling two or more similar containers to be interconnected with one another in a desired spatial relationship.

Empty containers of this nature can be used as parts of a construction kit for children. Thus they can interconnect a number of containers by means of the connection parts to construct quite complicated assemblies.

The flange may be a top of the container and the opposite end being a base of the container.

The connection parts may comprise complementary plug and socket formations.

The formations may have a circular cross-section, cruciform cross-section, rectilinear cross-section or any other suitable cross-section.

The connection parts may be integral with the base of the container.

The connection parts at the base may be on or in a flange extending laterally beyond the side wall(s) of the container as an extension of the base.

The container may taper inwardly towards the base so that similar containers can be stacked one within another.

The container may be used for the sale of foodstuffs or the like, in which case the top of the container may be covered by a removable foil sheet affixed to the flange.

The flange may have at least one connection part comprising a socket.

The flange may have two pairs of opposite corners within each of which there is a socket.

The sockets may be holes through the flange.

The connection parts of the base may comprise a cruciform shape with a projecting plug between each adjacent pair of arms.

The invention also extends to a building system comprising a number of containers as hereinbefore defined, and connector members adapted to interengage with the connection parts on the containers to interlink the containers together in a single assembly.

The connector members may comprise a plate member incorporating connection parts complementary to those of the containers.

There may be a plug member having projections which are complementary to recesses defining connection parts on the containers.

The plug member may comprise two, four or six projections extending in a regular array from a central point of the plug member.

There may be a patterned or printed sheet portion with an adhesive surface which can be stuck on to the containers.

The invention may be performed in various ways and preferred embodiments thereof will now be described with reference to the accompanying drawings, in which.

Figure 17:
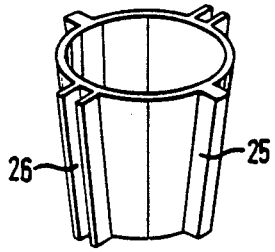
Figure 18:
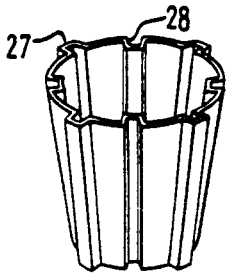

FIGS. 17 and 18 isometrically illustrate an alternative form of the invention.

Figure 19:
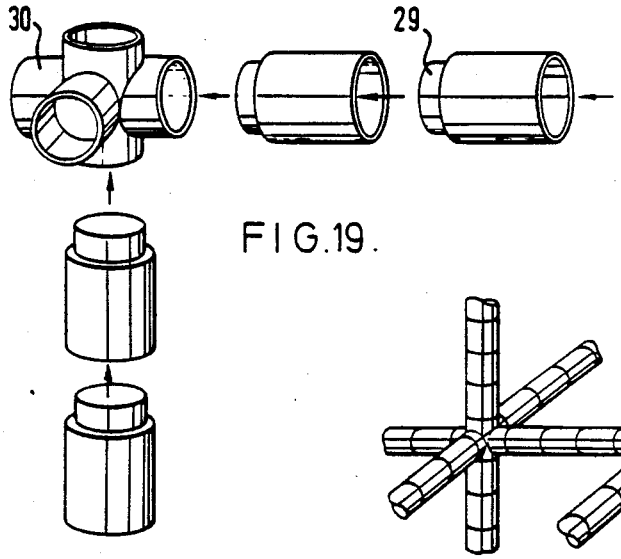
Figure 20:
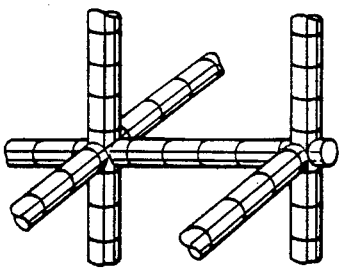
Figure 21:
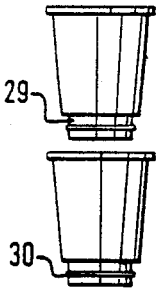
Figure 22:
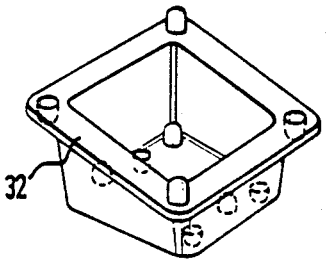
Figure 23:
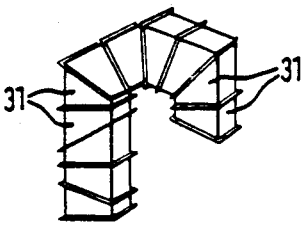
Figure 24:
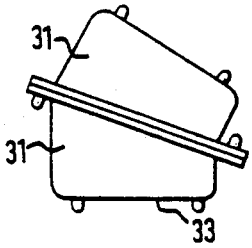
Figure 25:
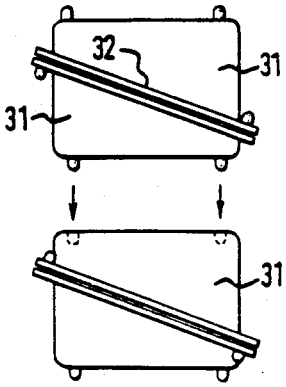
Figure 26:
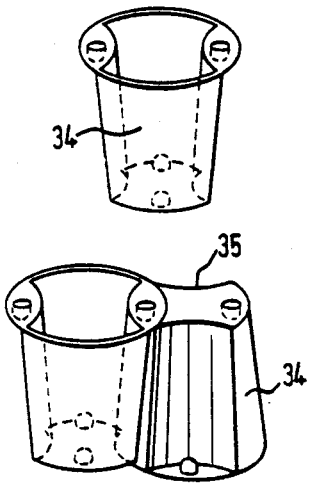
Figure 27:
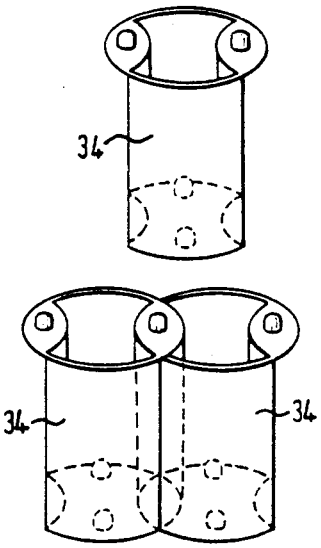

FIGS. 19, 20 and 21 isometrically illustrate alternative methods of interconnection of containers of the invention;

FIGS. 22, 23, 24 and 25 illustrate methods of interconnection of a modified form of container shape of the invention; and FIGS. 26 and 27 show two further alternative shapes for containers of the invention.

Figure 1:
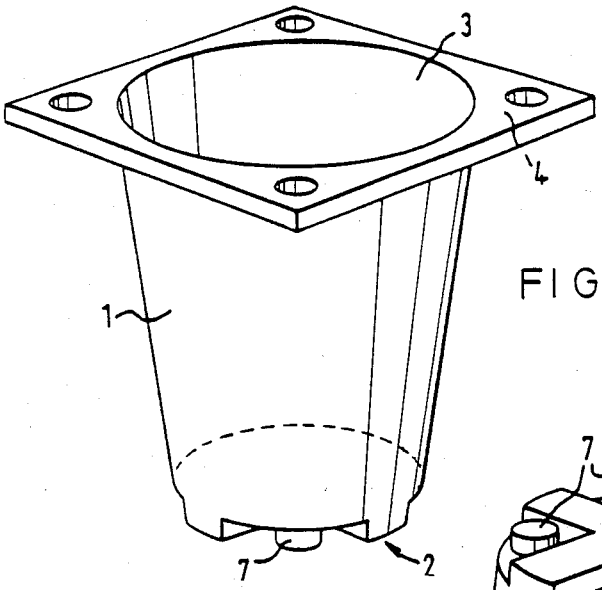
FIGS. 1 and 2 are top and underneath perspective views of a container of this invention.
Figure 2:
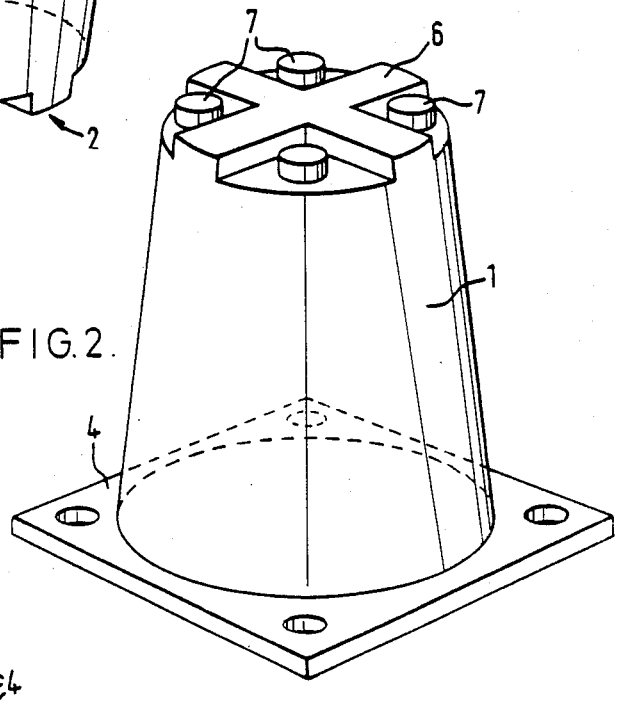

The container 1 shown in FIGS. 1 and 2 is a comestible container such as a yoghurt or cream pot and is of tub-like form with a side wall of circular cross-section tapering towards the base 2 from an open mouth 3. The base and mouth comprise opposite ends of the container. A flange plate 4 surrounds the open mouth 3 and is provided with sockets in the form of through holes 5 punched through each of the four corners. The base 2 of the container has a central cruciform projection 6 and in the angles between each pair of arms of the cruciform a projecting plug or stud 7 is formed. The holes 5 and studs 7 comprise mutually interengageable connection parts.

Figure 3:
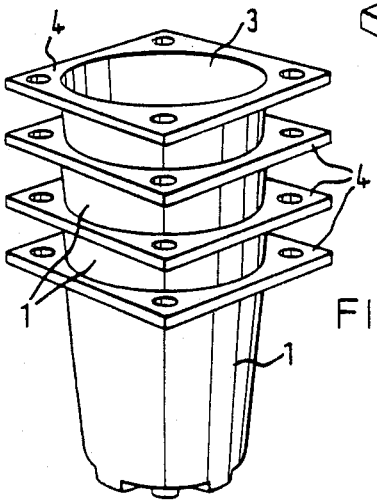
FIG. 3 illustrates a number of such containers built into a stack.

As can be seen from FIG. 3 because of the tapering nature of the containers they may readily be stacked one within the order for storage purposes. It will also be appreciated that the flange 4 can provide a support for a removable foil sheet which will seal in the contents (such as foodstuffs) which can be sold in the container. Once the foil sheet has been removed and the container has been emptied and washed it may be used as a construction toy, or building system, which is knock-down, in the manner as now will be described.

Figure 4:
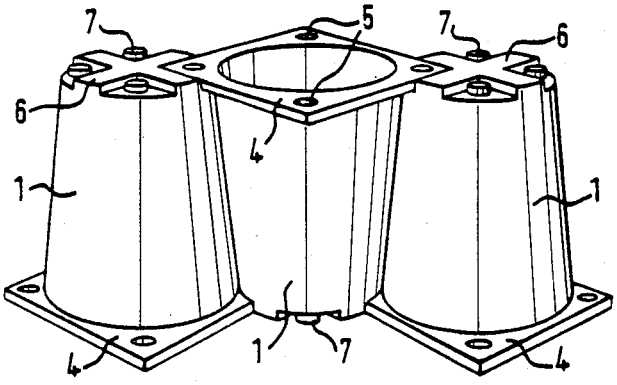
FIGS. 4 and 5 illustrate alternative means of interconnecting the containers.
Figure 5:
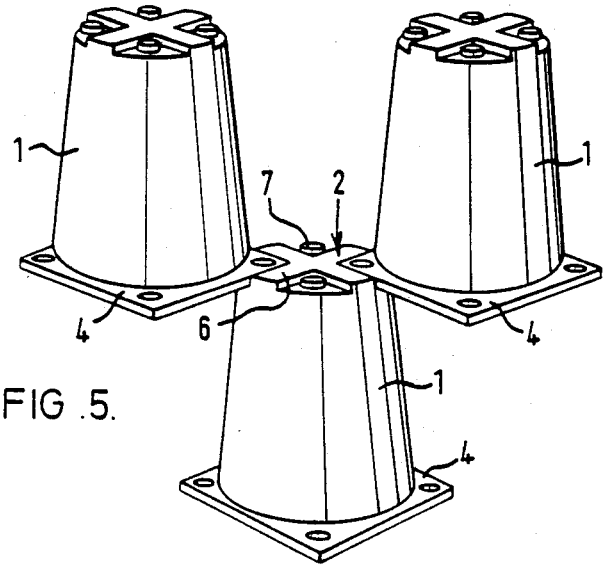
Figure 6:
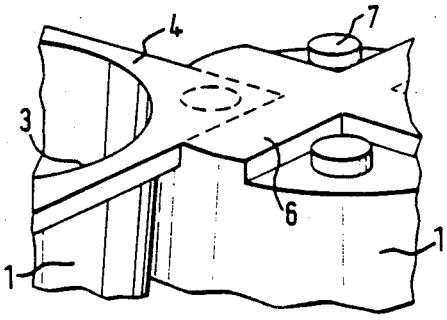
FIGS. 6 and 7 illustrate respective methods of interconnection of the containers as shown in FIGS. 4 and 5.
Figure 7:
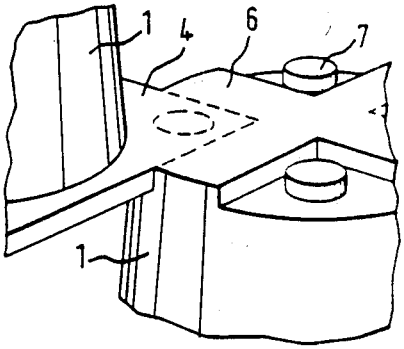

As shown in FIG. 4 three containers can be interlinked in a desired spatial relationship, in this case a lateral array, by inverting two of the containers and interengaging the studs 7 with the holes 5 in the flange plates 4. The corners of the flange plates will fit snugly into the angles between adjacent arms of the cruciform projection 6. This method of interconnection is shown in greater detail in FIG. 6 of the drawings. An alternative method of interconnection enables a vertical assembly to be constructed as shown in FIG. 5. In this case two inverted containers 1 are fitted with their flange plates mounted over studs 7 on the base 2 of another container 1. This method of interconnection is illustrated in more detail in FIG. 7.

Figure 8:
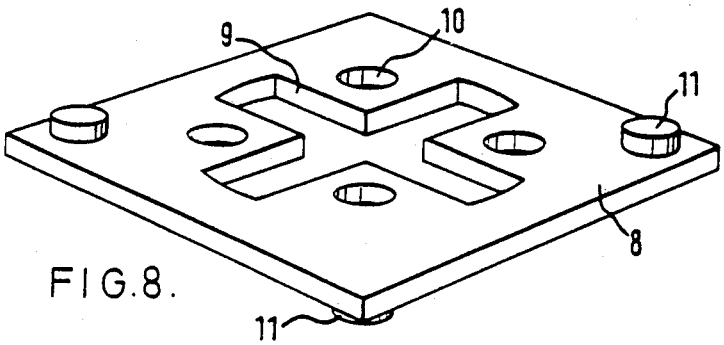
FIGS. 8 and 9 illustrate two forms of plate-like connector members for use with the containers of the form shown in FIG. 1.
Figure 9:
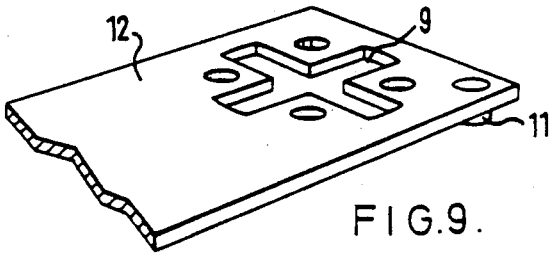
Figure 10:
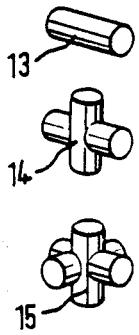
FIG. 10 illustrates plug-like connector members which may be used to interconnect the containers with the connector members shown in FIGS. 8 and 9.
Figure 11:
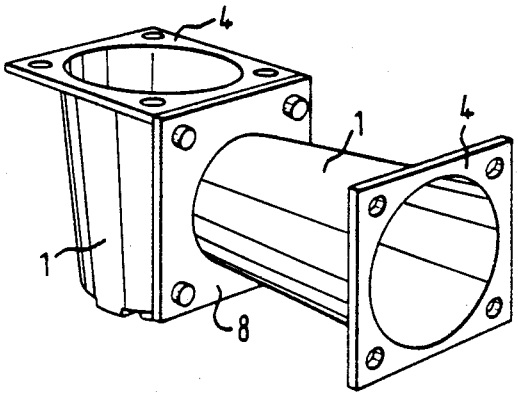
FIGS. 11 and 12 show two methods of interconnecting containers using a connector member of FIG. 8.
Figure 12:
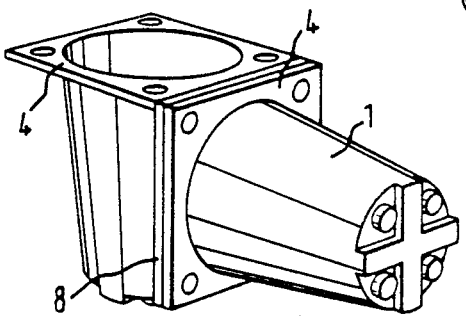

More versatile assemblies may be constructed using connector members of the forms as illustrated in FIGS. 8 to 10 of the drawings. Firstly there is a connector plate 8 having cut out portions defining a cruciform shape 9 and holes 10 so positioned that they will receive the cruciform projection 6 and studs 7 forming the base of a container 1. The corners of the plate 8 are provided with studs 11 (projecting alternately in opposite directions) which can be engaged within the holes 5 in the corners of the flange plates 4 of further containers 1. A modified form of plate 12 shown in FIG. 9 is of extended length and acts as a flat beam for extending the length of an assembly. The other end of the beam could, if desired, incorporate further interconnection configurations of the forms 9, 10 and 11 shown in FIG. 8. Plug members 13, 14 or 15 shown in FIG. 10 may be used to interconnect containers and/or plate connectors 8 or 12. These plug members have two, four or six projections extending in a regular array from a central point. In FIG. 11 two containers 1 have been interconnected through the medium of a connector plate 8 which is attached to the flange 4 of one of the containers by means of plug members 14 or 15 and a further container 1 has been fitted into the centre of the plate member 8 by means of the projections 6 and 7 on the base of the container. In the arrangement shown in FIG. 12 two containers have been interlinked so that their flanges 4 are adjacent but in planes at right angles to one another by using plug members 14 or 15 either with or without the connector plate 8.

Figure 13:
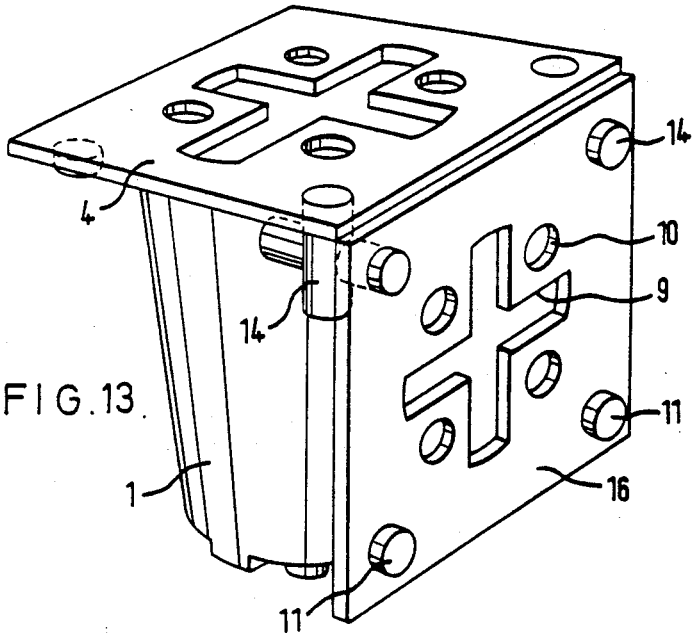
FIG. 13 illustrates a modified form of connector plate connected to a container.
Figure 14:
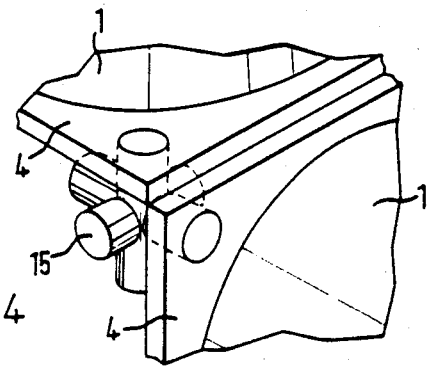
FIG. 14 is a detail of the arrangement of FIG. 13 showing how the parts are connected together.

In FIG. 13 a plate member 16 of slightly different form from that of FIG. 8 is illustrated. This has projecting studs 11 pointing in the same direction from the two bottom corners and holes are formed in the top two corners. Plug connectors 14 or 15 have parts projecting through two top holes in the plate 16 whilst other parts engage within the holes 5 in the flange 4 of a container 1. A flange plate 4 of another container can be engaged by means of the four projections 11 and 14 within the holes 5 in the flange plate 4 of the second container. A method of interconnecting a flange part 4 of a container with a connector plate 16 or a flange plate 4 of another container 1 by means of a plug member 15 is illustrated in more detail in FIG. 14.

It will be noted that the periphery of the flange does not form part of the projections or of the boundary of the holes. The projections and holes are separate from the periphery of the flange. This arrangement provides strength and rigidity in the connection between containers which is not provided when holes and projections are not separate from the periphery of the flange.

Figure 15:
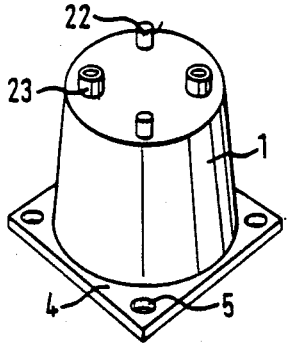

The somewhat simpler design of container illustrated in FIG. 15 dispenses with the cruciform projection 6. The studs may be of the simple form 7 or could, for example, be as shown in FIG. 15 as defining male and female interengaging parts 22 and 23.

Figure 16:
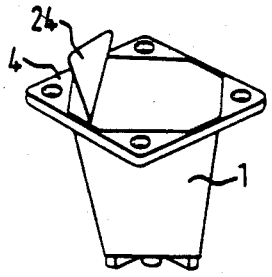

FIG. 16 shows how the container could be of square cross-section and the orientation of the flange 4 can be different from that of the walls of the container 1. A foil cover for enclosing the contents of the container is also shown at 24.

So far, there have been described containers with mutually engageable connection parts, some of which are located on a laterally extending flange portion separate from its periphery. In a further aspect of the invention there is provided a container formed with connecting parts of two complementary types extending uniformly along the length of an exterior wall of the container, the arrangement being such that when two containers are placed together with their said exterior walls adjacent, a connecting part of one type on one container engages a connecting part of the second type on the other container to join the containers together.

FIGS. 17 and 18 shown an example of such alternative means of interconnecting the containers. Thus in FIG. 17 the side walls are formed with projecting ribs 25 and projecting plates 26 defining a socket which will receive and grip a rib 25. In the alternative version shown in FIG. 18 the side walls of the container are of castellated form defining mutually engageable ribs 27 and grooves 28. The container in FIG. 18 has four ribs and four grooves allowing for greater variety of interconnection.

According to another aspect of the invention there is provided a container comprising a mouth at one end and a base at the other end, the base of the container being formed with a projection which will fit into and be gripped by the inner walls of the mouth of a similar container. An example of this form of container is shown in FIGS. 19 and 20, wherein the base of the container has a projection 29 which will fit into and be gripped by the inner walls at the other end of a separate container. Special plug members 30 may be provided to allow for changes in direction so as to construct a frame structure as shown in FIG. 20. A slightly modified form of container is shown in FIG. 21 where the extending portion 29 of the base is formed with a rib 30 which will lock into a complementary formation within the open mouth of the container.

A different form of container is illustrated in FIGS. 22 to 25. This is of generally square cross-section 31 and has a flange 32 which does not lie parallel to the base wall 33. Mutually engaging projections and recesses are formed on the flange 32 and in the base 33 enabling two containers 31 to be closed onto one another to cause the structure to move in a new direction. By re-orientating the upper container 31 a generally box-like structure may be defined as shown in FIG. 25. By this means a construction may be formed which changes direction as required, as illustrated in FIG. 19.

Two further types of container are illustrated in FIGS. 26 and 27. In these arrangements the side walls are formed with complementary projecting and indented formations 34, 35 so that when the containers are interengaged by means of mutually interlocking studs and holes, the containers will blend together in the manner illustrated. Whilst each of these containers is shown with two recesses and two projections, it will be appreciated that the numbers of these could be increaed to enable more elaborate structures to be built.

What is claimed is:

1. A container, comprising opposite ends, one end of the container having a laterally extending flange plate suitable for attachment of a foil closure, a portion of the flange plate within its periphery and an opposite end of the container incorporating mutually interengageable connection parts enabling two or more similar containers to be interconnected with one another in a desired spatial relationship, wherein the connection parts of said opposite end comprises a cruciform shape with a projecting plug between each adjacent pair of arms of said cruciform shape.

* * * * *